US005899109A

United States Patent [19]

Fisch

[11] Patent Number: 5,899,109

[45] Date of Patent: May 4, 1999

[54] INDEXING CONVEYOR FOR A DIE TRANSFER SYSTEM AND METHOD

[75] Inventor: Alfred C. Fisch, Clarkston, Mich.

[73] Assignee: Rapindex Incorporated, Bloomfield Hills, Mich.

[21] Appl. No.: 09/046,004

[22] Filed: Mar. 23, 1998

[51] Int. Cl.[6] ..... B21D 43/05

[52] U.S. Cl. ..... 72/405.16; 72/405.11; 72/405.01; 198/621.1

[58] Field of Search ..... 72/405.11, 405.12, 72/405.09, 405.01, 405.13, 405.16; 198/621.1–621.4; 100/207

[56] References Cited

U.S. PATENT DOCUMENTS

| | | | |
|---|---|---|---|
| 3,695,088 | 10/1972 | Alvi | 72/405.12 |
| 3,800,583 | 4/1974 | Miller | 72/361 |
| 4,449,390 | 5/1984 | Pontini | 72/405.12 |
| 4,753,103 | 6/1988 | Braun | 72/405.11 |
| 5,035,134 | 7/1991 | Fisch | 72/405 |
| 5,136,874 | 8/1992 | Fisch | 72/405 |
| 5,390,525 | 2/1995 | Fisch | 72/405 |
| 5,680,787 | 10/1997 | Fisch | 72/405 |

FOREIGN PATENT DOCUMENTS

| | | | |
|---|---|---|---|
| 531604 | 10/1976 | U.S.S.R. | 72/405.01 |
| 1433593 | 10/1988 | U.S.S.R. | 72/405.09 |

*Primary Examiner*—Daniel C. Crane
*Attorney, Agent, or Firm*—Barnes, Kisselle, Raisch, Choate, Whittemore & Hulbert

[57] ABSTRACT

A die transfer system that includes a lower die, an upper die carried for reciprocal movement toward and away from the lower die to perform at least one operation on a workpiece positioned therebetween, and a conveyor for sequentially conveying workpieces between the dies. The conveyor includes a pair of elongated transfer bars parallel to each other and to the direction of movement of workpieces through the dies. Each transfer bar includes hands for engaging and carrying the workpieces. A pair of transfer drives are each operatively coupled to an associated one of the transfer bars for moving the transfer bars longitudinally parallel to each other independently of each other and out of phase with each other. A workpiece infeed conveyor is disposed adjacent to one end of a first of the transfer bars for feeding workpieces to the first transfer bar. A workpiece outfeed conveyor is disposed adjacent to the same end of the second of the transfer bars for receiving workpieces from the end of the second transfer bar. A transfer conveyor is disposed adjacent to the other ends of the first and second transfer bars for transferring workpieces from the second end of the first transfer bar to the second end of the second transfer bar. In this way, workpieces are conveyed by the first transfer bar from the infeed conveyor to the transfer conveyor, then by the transfer conveyor to the second transfer bar, and then by the second transfer bar to the outfeed conveyor.

11 Claims, 3 Drawing Sheets

INDEXING CONVEYOR FOR A DIE TRANSFER SYSTEM AND METHOD

The present application is directed to die transfer systems, and more particularly to an improved conveyor for indexing workpieces through successive stations of the die assembly.

BACKGROUND AND OBJECTS OF THE INVENTION

In so-called progressive die systems, workpieces formed from strip stock remain attached to webs that extend along lateral edges of the pieces to facilitate indexing of the workpieces through successive stages of the die assembly. Although such arrangements facilitate conveyance of workpieces through the die stations, they possess the disadvantage that the workpieces must be formed in a linear array at spaced locations along the strip stock, leading to substantial inefficiency and waste. Furthermore, the fact that all workpieces remain interconnected during at least a major portion of the die operation can lead to difficulty and inefficiency in performing operations on the workpieces at a given station. For these reasons and others, so-called die transfer systems have been developed in which the workpieces are pre-separated and fed as individual units to the die arrangement. A die transfer system of this character permits more efficient use of the strip stock material, and also permits greater flexibility in operations that can be performed at the individual die stations. However, the conveyor arrangement for indexing individual workpieces through a die transfer system is more complex than those in typical progressive die systems, usually involving release and re-engagement with the workpieces at each of the individual die stations.

U.S. Pat. No. 5,136,874, assigned to the assignee hereof, discloses a die transfer system that includes a lower die, an upper die carried for reciprocal vertical movement toward and away from the lower die to perform at least one operation on a workpiece positioned therebetween, and a conveyor arrangement for sequentially conveying workpieces between the dies. The conveyor arrangement has a pair of conveyors disposed on opposite lateral sides of the lower die. Each conveyor includes a plurality of hands for gripping or otherwise engaging the workpieces, with the hands being spaced from each other lengthwise of the conveyor by distances corresponding to stations of the die. Each conveyor and its associated hands are indexed in a longitudinal direction through the die between the stations in synchronism with motion of the upper die. The hands are moved simultaneously in at least one direction perpendicular to the longitudinal indexing direction by a camshaft that extends through the stations along an axis parallel to the indexing direction. A cam is mounted on each camshaft for rotation with the camshaft in synchronism with motion of the upper die. A follower arrangement couples each cam to the hands of the associated conveyor, so that reciprocal rotation of the camshaft about its axis results in reciprocal motion of the hands in one or more directions lateral to the longitudinal direction of conveyance of workpieces through the die stations. The conveyor camshafts are rotated by cam-and-follower arrangements coupled to the upper die, or by electric servo motors controlled by a master controller.

U.S. Pat. No. 5,680,787, also assigned to the assignee hereof, discloses a die transfer system in which the conveyor for transferring workpieces between the dies includes a camshaft having an axis of rotation parallel to the direction of movement of workpieces through the die system, a transfer bar parallel to the camshaft axis carrying a plurality of hands for engaging the workpieces, and a cam arrangement coupling the camshaft to the transfer bar for moving the transfer bar both horizontally and vertically orthogonal to the camshaft axis. The cam arrangement includes a cam arm coupled to the camshaft and having a pair of angularly spaced drive rollers mounted thereon. Separate horizontal and vertical cam follower slots are disposed adjacent to the cam arm for sequential driving engagement by the rollers on the cam arm, such that rotation of the camshaft and cam arm brings the rollers into sequential engagement with the cam follower slots for driving the transfer bar horizontally and vertically with respect to the lower die.

Although the transfer systems and indexing conveyor arrangements disclosed in the noted patents address and overcome problems and deficiencies theretofore extant in the art, further improvements remain desirable. It is a general object of the present invention to provide an indexing conveyor and transfer drive system and method of the type disclosed in the noted patents that occupy reduced floor space and therefore form workpieces at reduced cost as compared with the prior art.

SUMMARY OF THE INVENTION

A die transfer system in accordance with the present invention includes a lower die, an upper die carried for reciprocal movement toward and away from the lower die to perform at least one operation on a workpiece positioned therebetween, and a conveyor for sequentially conveying workpieces between the dies. The conveyor includes a pair of elongated transfer bars parallel to each other and to the direction of movement of workpieces through the dies. Each of the transfer bars includes hands or other suitable means for engaging and carrying the workpieces. A pair of transfer drives are each operatively coupled to an associated one of the transfer bars for moving the transfer bars longitudinally parallel to each other independently of each other and out of phase with each other. A workpiece infeed conveyor is disposed adjacent to one end of a first of the transfer bars for feeding workpieces to the first transfer bar. A workpiece outfeed conveyor is disposed adjacent to the same end of the second transfer bar for receiving workpieces from the end of the second transfer bar. A transfer conveyor is disposed adjacent to the other ends of the first and second transfer bars for transferring workpieces from the second end of the first transfer bar to the second end of the second transfer bar. Workpieces are conveyed by the first transfer bar from the infeed conveyor to the transfer conveyor, then by the transfer conveyor to the second transfer bar, and then by the second transfer bar to the outfeed conveyor. In this way, total floor space required by the transfer system is reduced essentially by one-half.

A method of performing stamping operations on workpieces in accordance with a second aspect of the present invention includes the step of providing a lower die having a plurality of workstations disposed in parallel rows, and an upper die for reciprocal movement toward and away from the lower die to perform a stamping operation on workpieces disposed at each of the workstations. Workpieces are transferred in sequential steps from an infeed conveyor through one row of workstations, and then in sequential steps through the other row of workstations to an outfeed conveyor.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
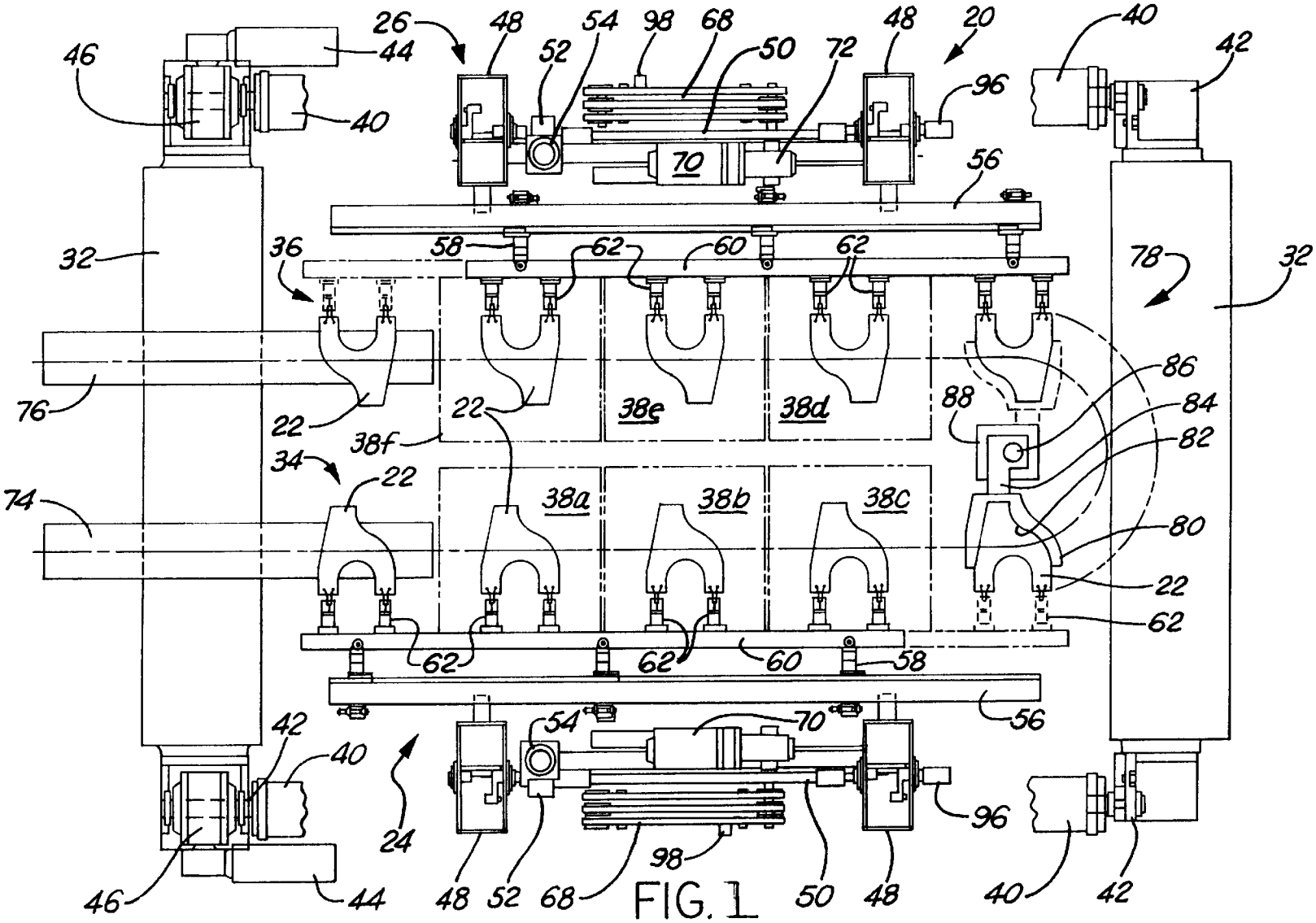
FIG. 1 is a top plan view of a die transfer system in accordance with one presently preferred embodiment of the invention.
Figure 2:
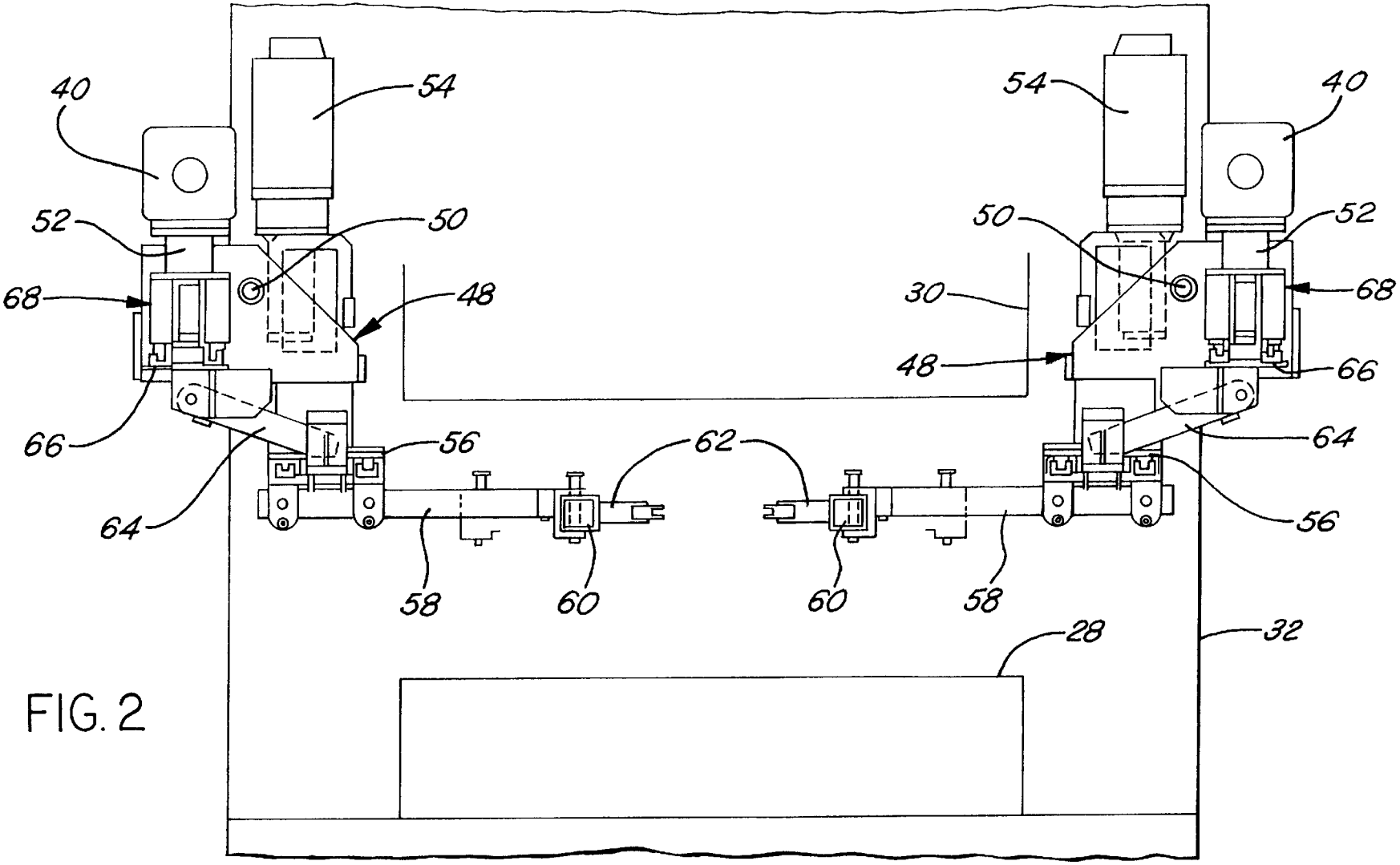
FIG. 2 is an end elevational view of the die transfer system illustrated in FIG. 1.
Figure 3:
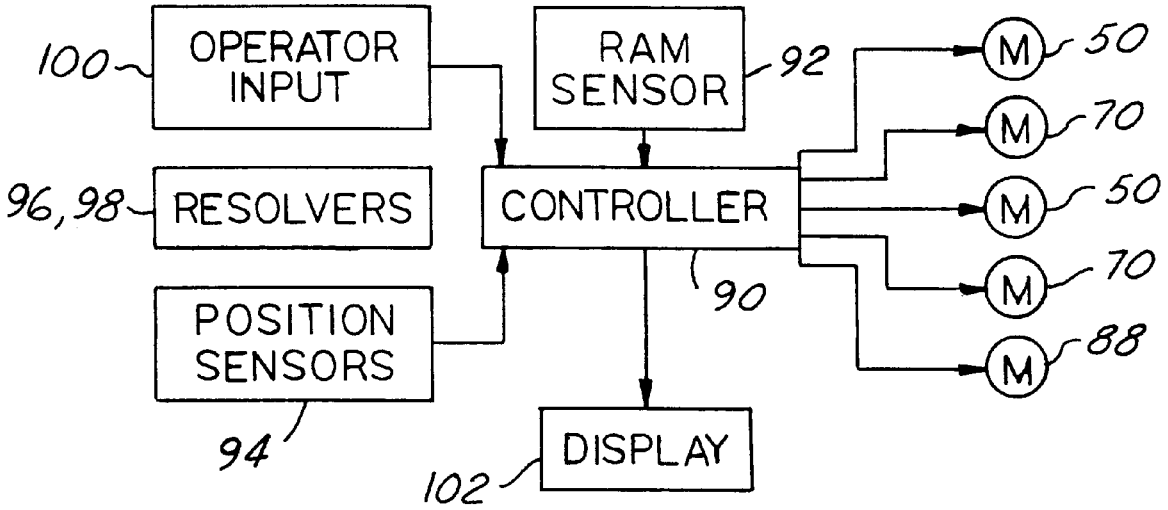
FIG. 3 is a functional block diagram of the electronic control system for operating the transfer system of FIGS. 1 and 2.

FIGS. 1–3 illustrate a die transfer system 20 in accordance with a presently preferred embodiment of the invention for indexing workpieces 22 through successive stations of a workpiece die. A pair of workpiece conveyors 24, 26 are positioned on laterally opposed sides of a lower die 28, and an upper die 30 is carried by a ram on a press support base 32 for vertical reciprocation with respect to lower die 28. In general, conveyors 24, 26 cooperate with the upper and lower dies to define a workpiece load station 34, a workpiece unload station 36, and one or more work stations 38*a*–38*f* positioned between the load and unload stations at which desired operations are performed on each workpiece 22 upon decent of the upper die. Details of the dies, geometry of the workpieces and operations performed thereon by the dies are not directly germaine to the present invention. In general, the constructions of conveyors 24, 26 are mirror images of each other, and are identical to those disclosed in above-noted U.S. Pat. No. 5,680,787, the disclosure of which is incorporated herein by reference.

Each conveyor 24, 26 includes a support beam 40 that is carried in fixed position relative to support base 32, such as being mounted on the support base, the press bolster, the press bed or the plant floor adjacent to the press. Each support beam 40 is pivotally mounted between opposed bearings 42, and is coupled to a motor 44 by a gear box 46 for swinging support beams 44, and conveyors 24, 26 carried thereby, upwardly and outwardly with respect to lower die 28 for operator access to the lower die and/or conveyors. Such construction is disclosed in U.S. Pat. No. 5,390,525 assigned to the assignee hereof. Alternatively, conveyor 24 and/or 26 may be mounted on a wheeled cart as disclosed in U.S. Pat. No. 5,570,604, or may be fixedly mounted to the support base as disclosed in above-noted U.S. Pat. No. 5,136,874, both assigned to the assignee hereof.

In general, each conveyor 24, 26 includes one or more cam box assemblies 48 connected by a drive shaft 50 and a gear box 52 to a servo motor 54. Each cam box 48 includes a cam arm operatively coupled to drive shaft 50, and horizontal and vertical carriages with cam slots for operative coupling to the cam arms as the cam arms are rotated by the drive shaft. The carriages are coupled in turn to a tooling carriage 56, which has arms 58 that carry a longitudinally extending transfer bar 60. The transfer bars 60 of the opposing conveyors 24, 26 are parallel to each other, and are parallel to the longitudinal direction of transfer of workpieces through system 20. Each transfer bar 60 carries a plurality of hands 62 for engaging and transferring workpieces 22 between the successive stations. Hands 62 are spaced from each other, in pairs in the system illustrated in the drawings, by distances that correspond to separation between the work stations. Each tooling carriage 56 is also coupled by a pair of longitudinally spaced arms 64 to a transfer carriage 66. Each transfer carriage 66 is coupled to the endless belt of an associated endless belt indexing conveyor drive 68. Each drive 68 is coupled to an associated drive motor 70 by a gear box 72. Thus, in general, transfer bars 60 are reciprocated longitudinally by operation of motors 70, gear boxes 72 and transfer drive mechanisms 68, and are reciprocated horizontally and vertically in directions orthogonal to the transfer direction by operation of motors 54, drive shafts 50 and cam boxes 48. Details of operation are discussed in greater detail in above-referenced U.S. Pat. No. 5,680,787.

An infeed conveyor 74 presents workpieces 22 in sequence to load station 34 adjacent to one end of transfer bar 60 of conveyor 24. Infeed conveyor 74 may be of any suitable type, such as an endless belt conveyor that receives sequential workpieces 22 from a source not shown. An outfeed conveyor 76, which again may be an endless belt conveyor, receives workpieces 22 in sequence at unload station 36 adjacent to one end of transfer bar 60 of conveyor 26. At the opposing ends of transfer bars 60, there is disposed a transfer station generally indicated at 78. In the preferred embodiment of the invention illustrated in the drawings, transfer station 78 comprises a nest 80 that has an internal pocket 82 contoured specifically to receive and hold workpieces 22. Nest 80 is coupled by an arm 84 to the shaft 86 of a servo motor 88. Thus, nest 80 may be rotated from the position shown in solid lines in FIG. 1 to that shown in phantom for transferring a workpiece 22 between the second or downstream end of transfer bar 60 of conveyor 24 to the second or downstream end of transfer bar 60 of conveyor 26.

Referring to FIG. 3, an electronic controller 90 provides individual and separately controlled outputs to the individual motors 50, 70 and 88. Controller 90 receives an input from a sensor 92 responsive to position of the ram coupled to upper die 30, and from position sensors 94 operatively coupled to drive shafts 50 to prevent overtravel in the movement of the workpiece hands horizontally into and out of engagement with the workpieces. A pair of resolvers 96 or other suitable sensors are operatively coupled to drive shafts 50 for indicating respective drive shaft positions. Likewise, a pair of resolvers 98 or other suitable sensors are operatively coupled to transfer drives 68 for indicating positions of the respective transfer drives. These resolvers 96, 98 provide additional inputs to controller 90. Controller 90 also receives input from an operator input station 100 such as a keypad, and provides an output to an operator display 102 such as a display screen.

In operation of the preferred embodiment, transfer bars 60 and workpiece hands 62 carried thereby are indexed at conveyors 24, 26 180° out of phase with each other by operation of controller 90 and indexing motors 70. The transfer bars are also moved in synchronism horizontally inwardly and outwardly, and vertically upwardly and downwardly, by operation of controller 90 through motors 54, drive shafts 50 and cam boxes 48. Thus, both transfer bars 60 move longitudinally simultaneously but in opposite directions, and both transfer bars 60 move vertically and laterally horizontally in synchronism with each other. Workpieces are brought to workpiece load station 34 by operation of infeed conveyor 74. When transfer bar 60 of conveyor 24 is in the position shown in solid lines in FIG. 1, a workpiece 22 at load station 34 is grasped by the associated workpiece hands. Conveyor 24 is then operated to move transfer bar 60 to the position shown in phantom lines in FIG. 1, which indexes all workpieces 22 carried by conveyor 24 one station horizontally—i.e., to the right in FIG. 1—through work stations 38*a*, 38*b*, 38*c* in sequence. At the downstream end of conveyor 24, workpieces are brought in sequence to transfer station 78, at which each workpiece in turn is placed in nest 80. Motor 88 is then operated by controller 90 to move the workpiece 22 in nest 80 to the position shown in phantom in FIG. 1 adjacent to the downstream end of transfer bar 60 of conveyor 26. With transfer bar 60 of conveyor 26 in the position shown in solid in FIG. 1, the workpiece 22 so transferred is grasped by the hands on the transfer bar. Transfer bar 60 of conveyor 26 is cycled by controller 90 to transfer the workpieces in the upstream direction—i.e., in a direction opposite to the direction of transfer of conveyor 24—through work stations 38*d,* 38*e* and 38*f* to unload station 36. Each time transfer bar 60 of conveyor 26 is brought to the position shown in phantom in FIG. 1, a workpiece 22 is deposited at unload station 36 onto outfeed conveyor 76 for transfer to subsequent operations or storage.

It will be appreciated, of course, that transfer bars 60 of conveyors 24, 26 are cycled longitudinally 180° out of phase with each other (in the preferred embodiment), and nest 80 is cycled by motor 88 and controller 90 in synchronism with operation of the transfer bars. In other words, nest 80 is brought into the position shown in solid lines in FIG. 1 prior to movement of conveyor 24 from the position shown in solid lines to that shown in phantom, at which a workpiece 22 is conveyed from station 38*c* to transfer station 78. As conveyor 24 is cycled from the position shown in phantom back to the position shown in solid to pick up a new workpiece at load station 34, conveyor 26 is cycled from the position shown in phantom to that shown in solid and nest 80 is cycled from the position shown in solid to that shown in phantom to place the workpiece 22 at the downstream end of conveyor 26 for loading onto conveyor 26. Conveyor 26 is then cycled from the position shown in solid to that shown in phantom (as conveyor 24 is simultaneously cycled from the position shown in solid to that shown in phantom) to convey the transferred workpiece 22 to station 38*d,* and to convey another workpiece 22 to unload station 36.

I claim:

1. A die transfer system that includes lower die means, upper die means carried for reciprocal movement toward and away from said lower die means to perform at least one operation on a workpiece positioned therebetween, and means for sequentially conveying workpieces between said die means comprising:

a pair of elongated transfer means parallel to each other and to the direction of movement of workpieces through said die means, each of said transfer means including means for engaging and carrying workpieces, a pair of transfer drive means each operatively coupled to an associated one of said transfer means for moving said transfer means longitudinally parallel to said direction independently and out of phase with each other, workpiece infeed means disposed adjacent to one end of a first of said transfer means for feeding workpieces to said one end of said first transfer means, workpiece outfeed means disposed adjacent to one end of a second of said transfer means for receiving workpieces from said one end of said second transfer means, and third transfer means disposed adjacent to the other ends of said first and second transfer means for transferring workpieces from said other end of said first transfer means to said other end of said second transfer means, such that workpieces are conveyed by said first transfer means from said infeed means to said third transfer means, then by said third transfer means to said second transfer means, and then by said second transferring means to said outfeed means.

2. The system set forth in claim 1 wherein said lower die means includes at least one work station adjacent to each of said first and second transfer means, said first transfer means operating to transfer workpieces in sequence from said infeed means to the adjacent work station and then to said third transfer means, said second transfer means operating to transfer workpieces in sequence from said third transferring means to the adjacent work station and then to said outfeed means.

3. The system set forth in claim 2 wherein said lower die means includes a plurality of work stations adjacent to each of said first and second transfer means, said first transfer means operating to transfer workpieces in sequence from said infeed means through the adjacent work stations in turn to said third transfer means, and said second transfer means operating to transfer workpieces in sequence from said third transfer means through the adjacent work stations in turn to said outfeed means.

4. The system set forth in claim 2 wherein said each of said first and second transfer means comprises a transfer bar carrying a plurality of hands for engaging workpieces.

5. The system set forth in claim 4 wherein each of said transfer drive means comprises means for cyclically indexing the associated transfer bar to transfer workpieces.

6. The system set forth in claim 5 wherein each of said transfer drive means further comprises means for moving the associated transfer bar in at least one direction perpendicular to the transfer direction.

7. The system set forth in claim 5 wherein said cyclically indexing means comprises means for cyclically indexing said transfer bars 180° out of phase with each other.

8. The system set forth in claim 1 wherein said third transfer means comprises a nest for receiving workpieces, and means for cyclically driving said nest between positions adjacent to said first and second transfer means.

9. The system set forth in claim 8 wherein said cyclically driving means includes an electric motor and means for operating said motor in synchronism with operation of said first and second transfer means.

10. A method of performing stamping operations on workpieces in sequence that comprises the steps of:

(a) providing a lower die having a plurality of work stations disposed in parallel rows, and an upper die for reciprocal movement toward and away from said lower die to perform a stamping operation on a workpiece disposed at each of said stations, (b) transferring workpieces in sequential steps from an infeed station through one row of said workstations, and then (c) transferring the workpiece in sequential steps through the other row of work stations to an outfeed station, and (d) providing a transfer bar adjacent to each said row of work stations, with means for engaging workpieces at the work stations, and wherein said steps (b) and (c) are accomplished by cycling said transfer bars out of phase with each other.

11. The method set forth in claim 10 comprising the additional steps of: (e) providing a transfer unit at adjacent ends of said transfer bars for transferring workpieces between said transfer bars, and wherein said steps (b) and (c) are accomplished by operating said transfer bars and said transfer unit in synchronism out of phase with each other.

* * * * *